United States Patent [19]

Nagel

[11] Patent Number: 4,974,669

[45] Date of Patent: Dec. 4, 1990

[54] COLLECTION AND REHEATING OF CONDENSATES

[75] Inventor: Philippe P. L. Nagel, Wemmel, Belgium

[73] Assignee: Hamon-Sobelco S.A., Brussels, Belgium

[21] Appl. No.: 466,517

[22] Filed: Jan. 17, 1990

[30] Foreign Application Priority Data

Jan. 25, 1989 [BE] Belgium ..... 8900076

[51] Int. Cl.[5] ..... F28B 9/08

[52] U.S. Cl. ..... 165/111; 165/110; 62/290

[58] Field of Search ..... 165/111, 110; 62/288–291

[56] References Cited

U.S. PATENT DOCUMENTS

| | | | |
|---|---|---|---|
| 1,711,332 | 4/1929 | Spiess | 165/111 |
| 1,887,313 | 11/1932 | Larkin | 62/290 |
| 3,306,071 | 2/1967 | Holyfield | 62/290 |
| 3,868,830 | 3/1975 | Fletcher et al. | 62/290 |
| 4,548,262 | 10/1985 | Hull | 165/111 |

FOREIGN PATENT DOCUMENTS

| | | | |
|---|---|---|---|
| 0109603 | 7/1983 | European Pat. Off. . | |
| 263464 | 11/1912 | Fed. Rep. of Germany . | |
| 1147246 | 4/1963 | Fed. Rep. of Germany | 62/288 |
| 497261 | 12/1919 | France | 62/290 |
| 1472838 | 1/1967 | France . | |
| 191376 | 1/1924 | United Kingdom . | |

*Primary Examiner*—Martin P. Schwadron
*Assistant Examiner*—Allen J. Flanigan
*Attorney, Agent, or Firm*—Walter H. Schneider

[57] ABSTRACT

Gas-condensation device consisting of an enclosure (3*a*) and chambers (1,2) for collecting the cooling fluid, the enclosure (3*a*) containing gases which are at least partially condensable and at least one bundle (3) of horizontal smooth tubes inside which the cooling fluid runs and which are arranged regularly in a bundle and supported by intermediate support plates and/or support grids (3*b*) situated between the collecting chambers, characterized by the replacement of at least part of an oblique descending row of tubes (3) by shaped elements (20) for catching and removing the condensates and which are each offset in a same direction relative to the upper neighboring element.

11 Claims, 6 Drawing Sheets

8

COLLECTION AND REHEATING OF CONDENSATES

INTRODUCTION—FIELD OF APPLICATION OF THE INVENTION

The present invention relates to devices which condense gases circulating outside smooth horizontal tubes which have a cooling fluid running inside them, in particular condensers and water heaters for power stations, but also numerous devices for the chemical and, in particular, the petrochemical industry.

The devices which fulfill this function are generally formed from horizontal banks (bundles) of tubes connected to chambers for collecting the cooling fluid. In general there is an inlet chamber and an outlet chamber for the cooling fluid; the cooling fluid leaves the device through this outlet chamber, having acquired the quantity of heat released by the condensation of the gases to be condensed.

The gases condense upon contact with the tubes which are colder than them; a condensate film is formed on the outer wall of the tubes. As a result of gravity, this film runs radially along the wall of the tubes and then falls onto the lower tubes. The tubes of the lowest banks of a device are consequently covered with a film of water which is much thicker than the banks situated above. This phenomenon has three disadvantageous consequences:

1. Barrier to heat transfer: the thicker the condensate film, the greater resistance it forms to heat transfer between the gas and the tube. In order to counteract this loss of efficiency, an excess surface area of condensing tubes must therefore be installed in order to successfully condense the desired quantity of gas.

2. Loss of energy: in many applications, it is desirable that the fluid resulting from the condensation of the gas, in other words the condensate, leaves the devices at a temperature as close as possible to the condensation temperature (in other words the gas gives the cooling fluid only those quantities of heat which are strictly necessary for its condensation). If the condensate leaves the device at a temperature which is lower than the condensation temperature, this means that the condensate has itself transferred quantities of heat to the cooling fluid.

In numerous industrial processes, this phenomenon, called "condensate subcooling" amounts to a loss of energy because the quantities of heat transferred to the cooling fluid are generally poorly employed, or even lost. Now the thicker the condensate film, the more it opposes the passage of the heat, and therefore the lower its mean temperature will be. Furthermore, the more condensing tubes the condensates meet as they fall, the more quantities of heat they can exchange with the cooling fluid in order to become subcooled. It can therefore be seen that the run-off of the condensates over superposed banks of tubes gives rise to a loss of energy translated by a condensate subcooling.

3. Dissolving of the noncondensable gases (in the temperature range in question): in numerous processes, there is a mixture of several gases outside the cooling tubes. A single gas condenses there (completely or partially), whereas the residual mixture of gases is extracted from the condensation space at a particular point on the device. The condensate which is formed has the property of being able to dissolve certain quantities of the other gases with which it is in contact.

This dissolving ability is correspondingly greater, the higher the subcooling of the condensate. Now this dissolving is often undesirable, for example for material corrosion reasons linked to the increase in the acidity of the condensates There is therefore also good reason to limit the subcooling in order to have a small quantity of dissolved gas.

The three phenomena described above are present simultaneously and very acutely in water-vapour condensers for medium- and high-power steam turbines (for example for power stations, boats . . . ). For this reason, the description will often refer to this application although it may be generalized, as mentioned above, to the majority of devices where gases are condensed.

STATE OF THE ART

The current technique consists either in reducing the mean number of tubes along which the condensates run off to a minimum, or in carrying out a subsequent reheating/degassing, as illustrated hereinafter with reference to FIGS. 1 to 9, in which FIG. 1 is a view in longitudinal section of a traditional heat exchanger;

FIGS. 2*a*, 2*b* and 3 diagrammatically illustrate various arrangements of the tubes of an exchanger;

FIG. 4 diagrammatically illustrates the insertion of drainage trays into vapour feed lanes;

FIG. 5 diagrammatically illustrates the removal of tubes for the insertion of drainage trays within a tube bundle;

FIG. 6 diagrammatically illustrates the arrangement of sealing strips perpendicular to the trays in order to limit the vapour leaks FIGS. 7 and 8 diagrammatically illustrate various means for creating a fine rain of condensates with a view to reheating them;

FIG. 9 diagrammatically illustrates the organisation of a countercurrent contact between the vapour rising between the tube banks and the condensates falling from bank to bank over the last banks.

In these various figures, identical reference symbols designate identical elements

A. REDUCTION IN THE MEAN NUMBER OF TUBES

FIGS. 2 to 5 illustrate the reduction in the mean number of tubes over which the condensates run off. This may be achieved by special arrangements of the tubes, illustrated in FIGS. 2 and 3.

In the heat exchanger shown in FIG. 1 by way of example of a device to which the invention may be applied, an inlet chamber 1 and an outlet chamber 2 for the cooling fluid may be seen. Between the two chambers, the cooling fluid passes in a tube bundle 3 outside which the gases to be condensed circulate in an enclosure 3*a*. The tubes 3 are supported by intermediate support plates and/or support grids 3*b*. By comparing FIGS. 2*a* and 2*b*, it is intuitively evident how the mean number of superposed rows of tubes over which the condensates run off may be reduced. In FIG. 2*a*, this mean number amounts to 3, whereas in FIG. 2*b*, it amounts to $(1+2+3+2+1)/5=1.8$. In this figure, V designates the vapour and C designates the condensate.

This technique is nevertheless limited by the fact that the orientation of the tubes must be compatible with good conditions for feeding vapour from the periphery of the bundle. Furthermore, the mean number of superposed tubes often still remains high in large-scale devices.

FIG. 3 illustrates another geometrical arrangement of the tubes, called tangential pitch, in the tube zone designated 4. The tangential path of the condensate is designated C.

In theory, the condensates therefore only run off over a limited number of tubes. Nevertheless, in the light of contradictory tests, many manufacturers have reservations about the reality of this method of condensate run-off, which at all times supposes a dominating influence of the surface tension on the wall of the tubes, relative to the forces of gravity (with the result that the condensates would at all times leave the tubes at their lowest points)

In addition, this pitch form entails many constraints which do not always make the bundle optimally effective as regards its gas feed or its construction cost.

The reduction in the mean number of tubes over which the condensates run off may also be obtained by intercepting the condensates by drainage trays either in an existing gap (generally a feeding lane), as shown in FIG. 4, or in a lane created within the bulk of the tubes with a view to inserting drainage trays as shown in FIG. 5.

In FIG. 4, the reference symbol 6 designates the drainage trays, 7 designates the gas admission lane and 8 the tube bundle or bundles.

It must be noted that in this case the geometry of the lanes (width, inclination and position), which is fixed by considerations of vapour feed, must be compatible with the requirements for fastening the drainage trays (available space) and for removing the collected condensates (sufficient inclination and unloading direction). In addition to this constraint, prior experience has shown that the insertion of these trays often forms an obstacle to the free distribution of the vapour.

In FIG. 5, the primary function of the lane 7 created in the bulk of the tubes in order to insert a tube 6 is not to feed in vapour.

Removal of rows of tubes in order to be able to insert the drainage trays is often required as a result of the tube bundles being very compact for economic reasons. The tubes are therefore very close to each other and there is not sufficient space to slide in and fasten a drainage tray.

The thickness of the drainage trays and their fastening conditions mean that there is often a significant distance d (FIG. 5) left between them and the closest tube banks.

This fact gives easy and undesired access to the vapour which may thus bypass certain parts of the bundle, for example by the leakage channels AB and CD in the simplified example in FIG. 5. The efficiency of the exchanger may be greatly reduced as a result. This leakage problem may be resolved by arranging sealing strips 9 perpendicular to the plate (FIG. 6), but the latter considerably complicate manufacture.

In addition, the presence of a plate disturbs the normal distribution of vapour within the tube bundle; it is common to find poorly fed pockets behind certain plates. These pockets make a part of the exchange surface not very active, or even completely inactive. Furthermore, the noncondensable gases are generally trapped in these pockets where they preferentially dissolve in the condensates and create problems of corrosion of the exchange tubes, as has been noted on numerous devices.

B. ELIMINATION OF SUBCOPLING BY A SUBSEQUENT REHEATING/DEGASSING

FIGS. 7 to 9 illustrate another means employed by the prior art for reducing as far as possible the subcooling of the condensate by carrying out a subsequent reheating/degassing.

For the reasons mentioned hereinabove, numerous constructors have discontinued using condensate-drainage trays but are trying to eliminate the consequence of the problem by causing the condensates which leave the bundle to pass into a device which reheats them and (consequently) degasses them. As a degree of subcooling is always inevitable, even with drainage trays, this device exists in virtually all cases. A standard device consists of organizing a fine rain of condensates having the largest possible exchange surface and the greatest possible fall time. As a result, there is a long and significant contact with the surrounding vapour which reheats the condensates. Some constructors place, for example perforated trays in the bottom of the bundles in order to organize this rain (FIG. 7).

In this figure, 8 designates a tube bundle, 10 designates a perforated tray catching the condensates which thus fall in a fine rain C; the symbol V designates the vapour.

Other constructors use multiple tray degassers (FIG. 8). The condensates formed by the bundles 8 fall onto a drainage tray 11 and from the latter onto a three-tray cascade 12. Still other constructors take advantage of the rain resulting from the free fall of the condensates leaving the last tube banks. In addition, they organize a countercurrent between the vapour V and the condensates in the last lower banks in order to counterbalance as far as possible the subcooling effect of these tubes (FIG. 9).

It should be noted that this subsequent reheating does nothing to resolve the problem of the partial loss of efficiency of the tube bundle caused by excessively large condensate-film thicknesses.

The following conclusions can be drawn from this state of the art :

1. The reduction of the flooding of the tubes may be achieved by a harmonious arrangement of the tubes but the efficiency will still only be very partial.

2. One of the best means for minimizing the flooding of the tubes is using drainage trays which, in the state of the art, have the following disadvantages :

- disturbance of the free distribution of the vapour in the bundle and causing corrosion of the bundle; causing of vapour leaks along the drainage trays, which
- bypasses the tubes and reduces the efficiency of the bundle;
- complication in manufacture linked to the fastening and installation of multiple trays between tube banks (for some condensers for power stations several one piece trays 20 m long by more than 1 m wide would be required).

3. In addition to using drainage trays, it is common to attach a degassing/reheating device to the tube bundle. This device has the following disadvantages :

- it does not resolve the prior problem of inefficiency in the heat transfer linked to the flooding of the tubes;
- it often also requires expensive and large-sized plate assemblies.

DESCRIPTION OF THE INVENTION

The invention aims to overcome the disadvantages of the prior art, in other words the partial loss of efficiency of the tubes bundle caused by excessively large condensate-film thicknesses.

To this end, there is provided in the condensation device according to the invention the replacement of at least part of an oblique descending row of tubes by shaped elements for catching and removing the condensates and which are each offset in a same direction relative to the upper neighbouring element.

Other characteristics and features of the invention will emerge from the following description, made with reference to the drawings attached hereto, in which FIG. 10 shows in diagrammatic section the arrangement of a set of catching profiles in a tube bundle;

FIG. 10*a* shows in a larger-scale section two catching profiles offset relative to each other;

FIGS. 11 to 13 illustrate, in a tube bundle, several alternative catching profiles;

FIG. 14 diagrammatically illustrates the invention within the scope of a tube bundle condensing water vapour discharged from a turbine.

The invention consists in substituting a certain number of tubes which follow each other in a suitable alignment by an equivalent number of judiciously shaped elements 20 (hereafter termed "profiles") arranged in a cascade, the shape of which enables them to be threaded through the support plates and/or support grids for the tubes in a manner similar to that of the tubes. The profiles are threaded through openings 21 which are either preferably identical to those through which the tubes pass and regularly situated in the set of openings, or have any shape and are situated at approximately the location which one or more openings for tubes regularly situated in the bundle would have. The perforated pattern of a sagging plate or the meshing of a grid may be used in particular.

The profiles 20 are aligned directly below each other and each offset relative to the following one in a same direction. Each profile 20 of an aligned set of profiles catches the condensates from the upper profile (except for the first profile in the alignment) and from upper tubes 3 and conveys them to the lower profile. The condensates therefore fall in a cascade from profile to profile. The systematic offset of the upper profiles to the lower profiles in a same direction allows a large width of the tube bundle to be covered and the condensates to be removed by a multitude of tubes outside the bundle.

The profiles are characterized by an appropriate geometry which must fulfil the following conditions:

(a) allow the installation as described hereinabove, in other words have a size compatible to the openings provided for the tubes;

(b) allow catching of virtually all the condensates falling from the parts situated above these profiles and ensure the removal of these condensates along a determined line of these profiles so that they can be correctly caught;

(c) ensure a degree of obstruction comparable to that of the surrounding tubes so that the free distribution of the vapour is not fundamentally modified. In particular, not to create preferred vapour passages along the profiles or, conversely, not to reduce the passage of vapour feeding the neighbouring tubes.

The profiles according to the invention have three edges or characteristic lines, designated D, R and G (see FIGS. 10 and 11).

"D" is a so-called discharging edge, that is the outer edge of the profile by which the condensate is to fall in a cascade onto the lower profiles It is therefore on the side which overhangs the lower profile, which is offset, that is on the side of the offset of the profiles, a side situated in the lateral direction of the removal of the condensates "G" is the upper edge of the profile termed guard edge, which has a twin guard role, relative to the catching of the condensates from the upper profile and relative to the fall of the condensates to the lower profile respectively. The lateral position of the edge G of any profile P is such that, given the offset of the profiles (an offset which is sufficiently small so that there is vertical overlapping ch of the profiles), the condensates which fall from the upper profile are virtually all caught between the edges G and D of this profile.

The situation of the edge G relative to the vertical is such that it prevents any overflowing of the condensates caught between G and D over the edge G on the side opposite D, in other words outside the alignment of the profiles, which would return the condensates to the tubes, precisely what it is desired to prevent.

The position of G therefore determines a lateral guard for catching the condensates and a vertical guard against returning the condensates. In FIG. 10a, Ga designates the guard height.

"R" are the end edge or two end edges or end horizontal straight lines of the profile which are situated on the side opposite D at a minimum distance relative to the neighbouring tubes. According to the geometry of the profile, one or two lateral tubes are involved; this is why there may be 1 or 2 points R per profile.

In order to satisfy the above condition c), the distances of the edges D and of the edges or lines R from the neighbouring tubes are equal to or differ only slightly from the minimum inter-tube distances. It is this condition which defines the position of the edge D. As the latter must be situated significantly lower than the edge G, there is only one neighbouring tube to be considered on the side of the offset of the profiles.

When, on the side opposite the offset, in other words on the side of the edge D, the outer surface of the profile is, at least over a certain extent, identical to that of a tube, the point where the distance between this surface and the neighbouring tube or 2 tubes is the shortest may be a horizontal generatrix for this cylindrical surface and not an edge. This is the case for the rounded profile d shown in FIG. 11.

In order to enable a profile of this type to be threaded into the normal openings of the plates or support grids for the tubes, the distance between any two points on the periphery of any section of the profile between two support plates or support grids may not be greater than the diameter of these openings. Moreover, at the locations of the support plates or support grids, the profiles must be provided with a recess corresponding to the projection of the profile outside the tube space.

After it has been threaded longitudinally, the profile is pressed laterally and pivoted so that its recesses become wedged in the support plates or support grids.

In other variants, the openings for the profiles in the support plates or support grids are also circular but their diameter differs from that of the openings for the tubes and/or their positions differ from those which the openings for tubes regularly positioned in the bundle would have.

Figure 1:
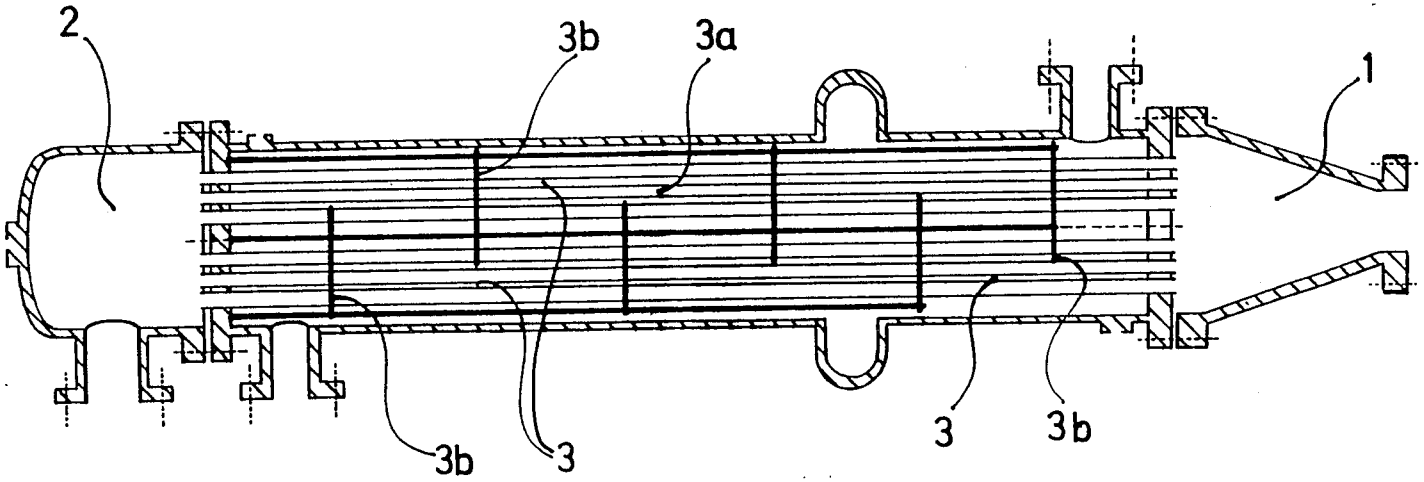
FIG. 1 PRIOR ART
Figure 2A:
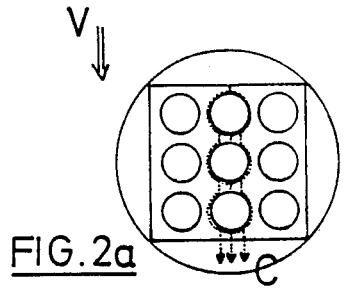
Figure 2B:
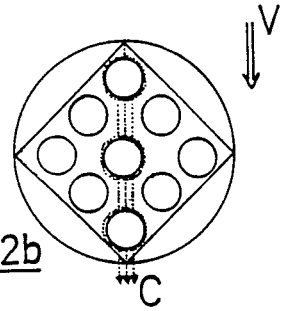
Figure 3:
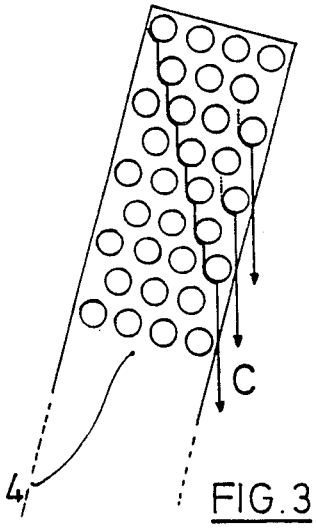
Figure 4:
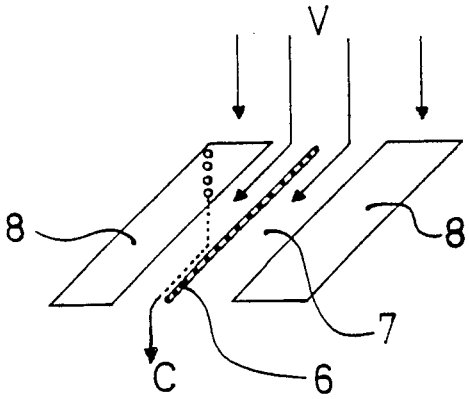
Figure 5:
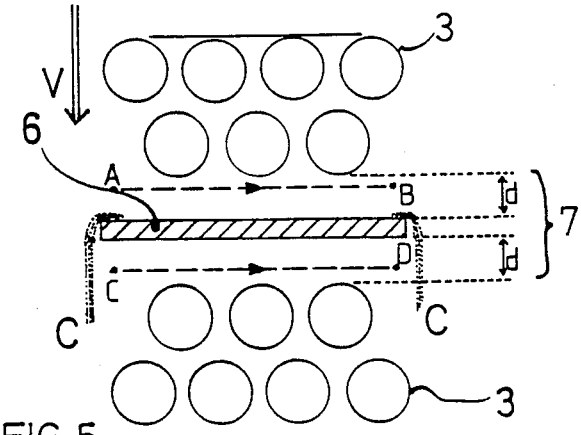
FIG. 5 PRIOR ART
Figure 6:
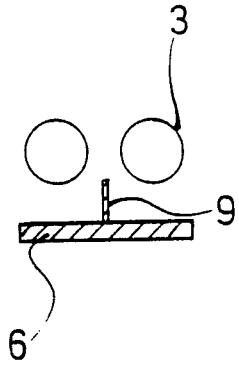
Figure 7:
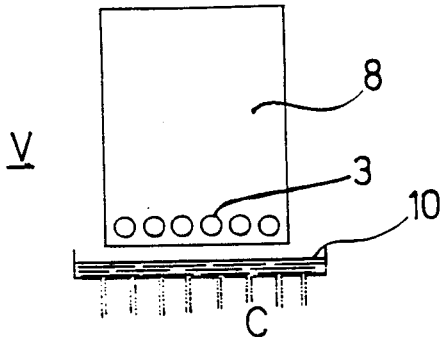
Figure 8:
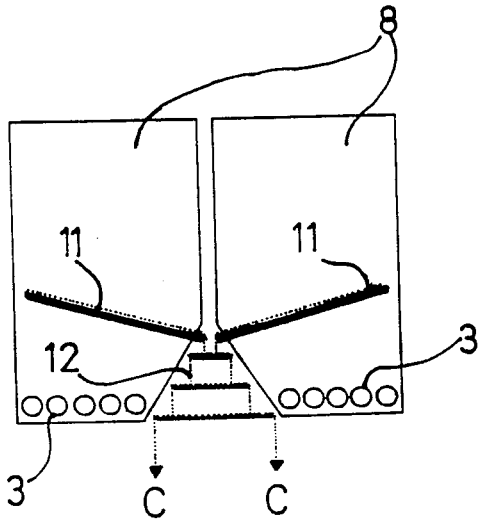
Figure 9:
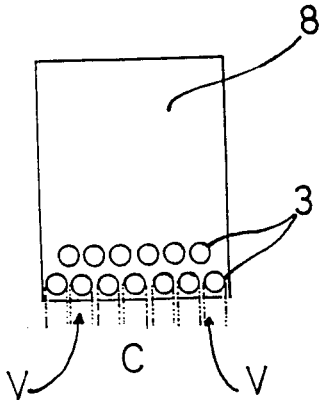
FIG. 9 PRIOR ART
Figure 10:
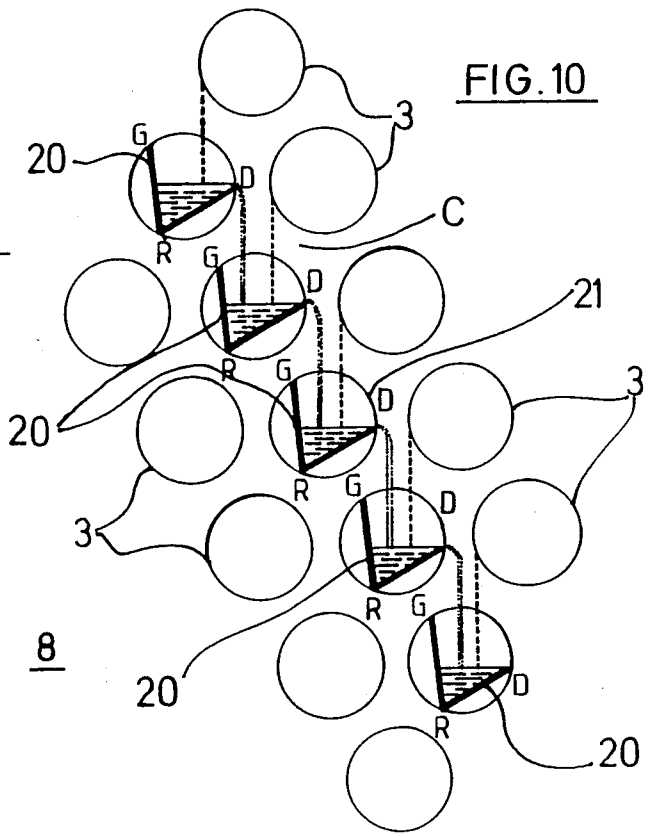
Figure 10A:
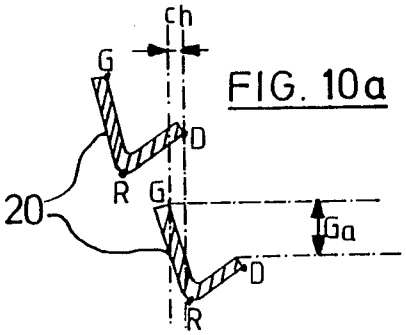
Figure 13:
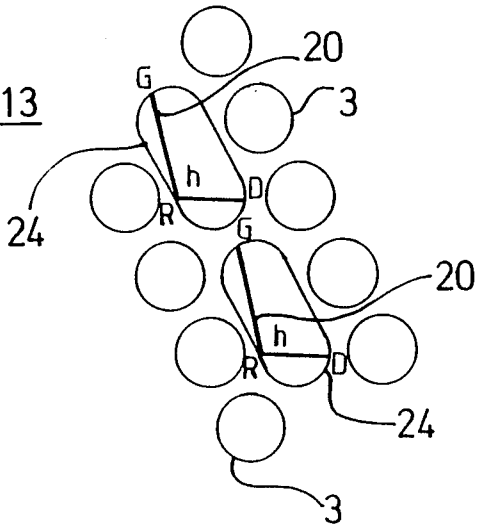
Figure 12:
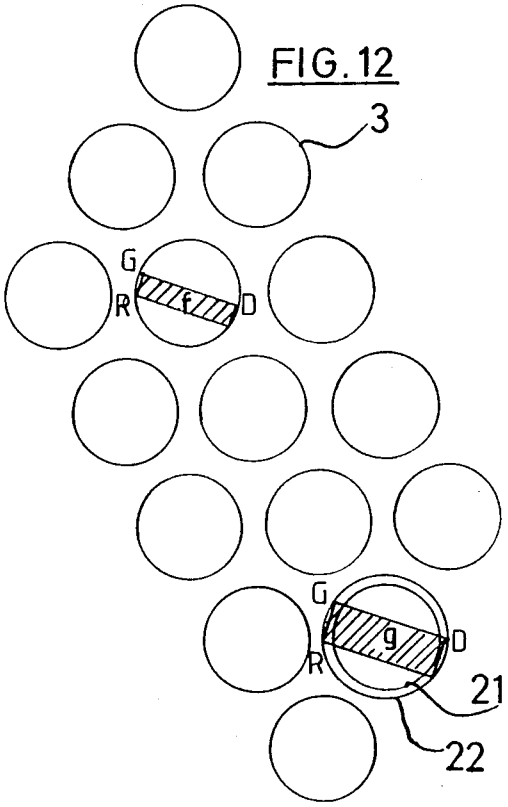
FIG. 12 shows, inter alia, a variant of the device for catching the condensates where, in its final position, the edge D of the profile f projects from the normal tube space of the tube bundle.
Figure 11:
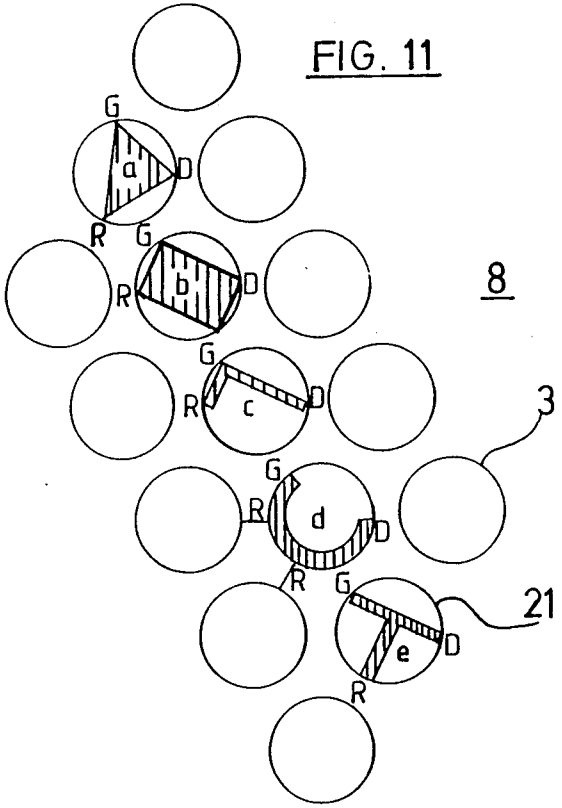
FIG. 11 shows a device for catching condensates where five variants ("a" to "e") of the profiles in FIG. 10 are shown by way of examples. All these profiles are inscribed in the normal tube space of the tube bundle 8.

FIG. 12 also shows a profile g similar to the profile f but without a recess and consequently supported by support plates whose opening corresponding to these profiles is not exactly at the point which the openings 21 for tubes regularly situated in the bundle would have, in this case in openings 22 with a larger diameter In another variant (profile h) shown in FIG. 13, the profiles are situated in oblong openings 24, the width of which is equal to the diameter of the openings for the tubes and which extend lengthwise over at least two successive tubes (either over a length equal to 2 tube diameters+1 inter-tube distance). This variant is, however, probably slightly less satisfactory than the previous ones but this disadvantage could be compensated for by a smaller cost.

Figure 14:
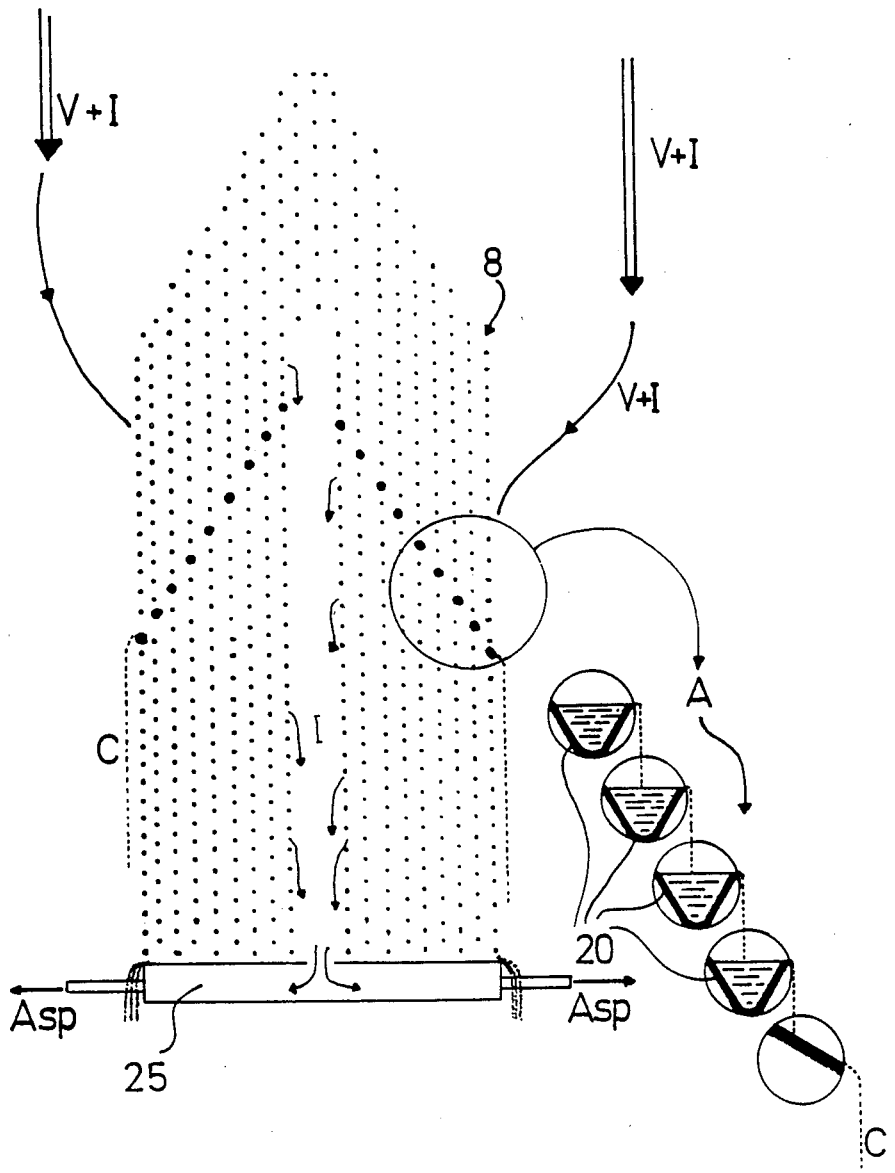

FIG. 14 diagrammatically illustrates the invention within the scope of a tube bundle condensing water vapour discharged from a turbine. It should be noted that the shape of the bundle is diagrammatic and simply a guide. It does not correspond to a determined marketed device.

In this figure, V designates the vapour, I the noncondensables, A an enlarged detail, C the condensates, 25 the zone for extracting the noncondensables, ASP their suction and 20 the profiles.

Installation of these profiles requires:

no supporting and fastening device other than those existing for the tubes;

no adaptation of the spatial distribution of the tubes other than the removal of certain tubes in order to replace them with these profiles In particular, the shape of the tube bundle must not be designed in dependence on the existence of the profiles. The latter can be adapted to any bundle shape since they may be simply substituted for existing tubes;

no substantial mechanical weakening of possible tube support plates as is the case, for example, when large cut-outs are made in them in order to slide large one-piece baffles therein.

The device according to the invention simultaneously fulfils the three following functions:

1. catching and removal of the condensates without having the disadvantages of the drainage trays (complicated mounting, obstruction effects, vapour leaks along the trays );

2. effective reheating of the caught condensates. The condensates are removed by effecting a cascade fall from profile to profile. This ensures a substantial contact time between the subcooled condensates and the surrounding vapour. In addition, in numerous envisaged applications, the thickness of the film running off in a cascade will often be less than 1 mm. This film is not continuous when it falls. The cascade therefore does not form a continuous obstacle, as does a drainage tray. This guarantees the vapour easy access to the tubes situated lower than the cascade. In addition, this thin-film cascade is very effective as regards heat transfer, and therefore reheating of the subcooled condensates. By way of example, a cascade of 10 successive profiles representing an approximate height of 30 cm, is equivalent to the effect of a free fall of the condensates from a height of 2 to 3 meters, which generally cannot be installed in industrial devices;

3. degassing of the caught condensates. The reheating of the condensates may be accompanied by a degassing of the noncondensable gases which are dissolved therein The additional advantage achieved in this case is that a large part of the noncondensable gases is thus extracted from within the tube bundle itself as a result of a cascade fall over elements which do not contribute to a further subcooling (which would tend to dissolve the noncondensable gases again) as would be the case with a fall over tubes. These noncondensable gases therefore continue to accompany the vapour in its normal path which, in every satisfactory tube bundle design, ends at a well-determined point from where they are extracted (for example by a vacuum pump).

Another point which should be noted is that if the profiles are welded to the various tube supports, they may carry out a fourth function: mechanical reinforcement of the mounting of the tube supports.

In addition, it should be noted that, whereas orifices must be provided in the tube supports, orifices which are identical to those provided for the tubes, no orifice can, of course, be made for the profiles in possible tube plates for the end of the devices (which separate the "vapour" space from the chambers for collecting the cooling fluid).

The geometries of the profiles which fulfil these conditions are multiple and may be obtained, for example, either from standard sections or by shaping thin metal sheets (drawing; pressing; bending . . . ).

I claim:

1. Gas-condensation device comprising an enclosure (3*a*) and chambers (1,2) for collecting the cooling fluid, the enclosure (3*a*) containing gases which are at least partially condensable and at least one bundle (3) of horizontal smooth tubes inside which the cooling fluid runs and which are arranged regularly in a bundle and supported by intermediate support plates and/or support grids (3*b*) situated between the collecting chambers, characterized by the replacement of at least part of an oblique descending row of tubes (3) by at least three shaped elements (20) for catching and removing the condensates and which are each offset in a same direction relative to the upper neighbouring element.

2. Condensation device according to claim 1, characterized in that each shaped element (20) is inscribed in a geometrical cylinder (21), the generatrices of which are parallel to the tubes, extends over at least part of the length of the bundle and has at least three characteristic generatrices (D,G,R), a first one of which is a discharging edge (D) from where the condensate falls from the shaped element (20) and in its free fall reaches the lower shaped element (20), the discharging edge (D) being situated at the periphery of the shaped element (20) on the side where this element overhangs the lower shaped element, at a height which reduces the distance between the discharging edge and the neighbouring lateral tube (3) situated on the same level to a minimum, the second characteristic generatrix of the shaped element (20) of which is a guard edge (G) situated at a level above that of the discharging edge (D), on the side of the shaped element (20) opposite that of the discharging edge (D), at a distance such that the condensates falling in a free fall from the upper shaped element (20) and from the upper tube (3) reach the shaped element (20) in question between its abovementioned edges (D and G), and the third and, optionally, a fourth characteristic generatrix (R) of which, which may also be edges, is or are situated on the periphery of the shaped element (20) on the side opposite the offset of the shaped elements (20) at a point which reduces the distance between this shaped element (20) and a neighbouring lateral tube (3) to a minimum.

3. Condensation device according to claim 1 characterized in that the shaped elements (20) for catching and removing the condensates substantially occupy the site of the tubes of the missing series of tubes.

4. Condensation device according to claim 1 characterized in that the shaped elements (20) are supported by the existing intermediate support plates and/or support grids (3*b*).

5. Condensation device according to claim 2, characterized in that the intermediate support plates and/or support grids (3*b*) are those of a complete bundle of tubes where there is no specific provision for receiving an intermediate device for catching and removing the condensates.

6. Condensation device according to claim 2, characterized in that the shaped elements (20) for catching and removing the condensates have a gutter shape.

7. Condensation device according to claim 6, characterized in that, according to an orthogonal section of the shaped elements (20), the upper contour GD of these elements is concave.

8. Condensation device according to claim 7, characterized in that, according to an orthogonal section of the shaped elements (20), the upper contour GD of these elements is rectilinear.

9. Condensation device according to claim 7, characterized in that, according to an orthogonal section of the shaped elements (20), the upper contour GD of these elements is convex.

10. Condensation device according to claim 2, characterized in that one or more elements of the series of shaped elements (20) have a form which differs from that of the majority of the shaped elements (20).

11. Condensation device according to claim 10, characterized in that the lower shaped element (20) differs from the other shaped elements (20).

* * * * *